United States Patent [19]

Smrt

[11] Patent Number: 4,688,769

[45] Date of Patent: Aug. 25, 1987

[54] FENCE BRACKET

[76] Inventor: Thomas J. Smrt, 640 Industrial Dr., Cary, Ill. 60013

[21] Appl. No.: 887,385

[22] Filed: Jul. 21, 1986

[51] Int. Cl.[4] ..... E04H 17/14

[52] U.S. Cl. ..... 256/65; 256/DIG. 4; 256/48; 403/397

[58] Field of Search ..... 256/DIG. 5, DIG. 4, 256/48, 54, 65; 403/398, 397

[56] References Cited

U.S. PATENT DOCUMENTS

| | | | |
|---|---|---|---|
| 57,073 | 8/1866 | Bettis | 256/65 |
| 266,988 | 11/1882 | Gleason | 256/DIG. 5 |
| 1,102,394 | 7/1914 | De Ros | 256/54 |
| 1,207,344 | 12/1916 | Thiele | 256/54 X |
| 1,454,649 | 5/1923 | Murton | 256/54 |
| 1,499,933 | 7/1924 | Jones | 256/48 |
| 1,509,835 | 9/1924 | Grossenbach | 403/398 X |
| 2,150,291 | 3/1939 | Paque | 256/DIG. 5 |

*Primary Examiner*—Andrew V. Kundrat

*Attorney, Agent, or Firm*—Wood, Dalton, Phillips, Mason & Rowe

[57] ABSTRACT

A fence bracket for mounting adjacent fence rails in fixed relation on a fence post includes first and second fingers extending around a portion of the fence post and each having a hooked portion which is disposed over and engages the flange of the post wherein at least one of the fingers is engageable with one of a series of protrusions on a face of the post to limit movement of the bracket thereon. Means are also provided between the first and second fingers for supporting overlapping ends of adjacent rails whereby a fastener may be driven through the overlapping ends to secure the rails in fixed relation on the post. The bracket may be installed from the side of the post and hence does not require the prior removal of other fencing apparatus supported by the post.

12 Claims, 6 Drawing Figures

FIG. 1
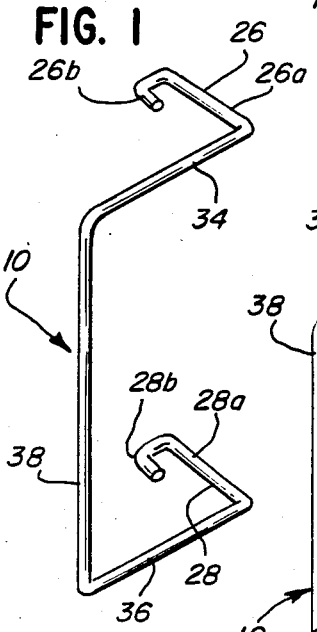
FIG. 2
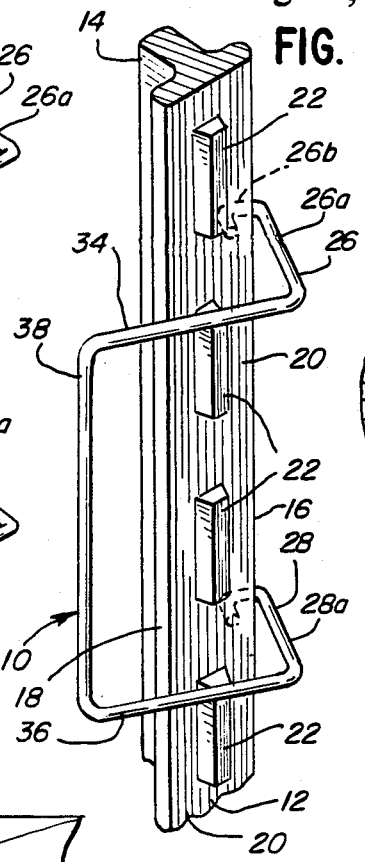
FIG. 3
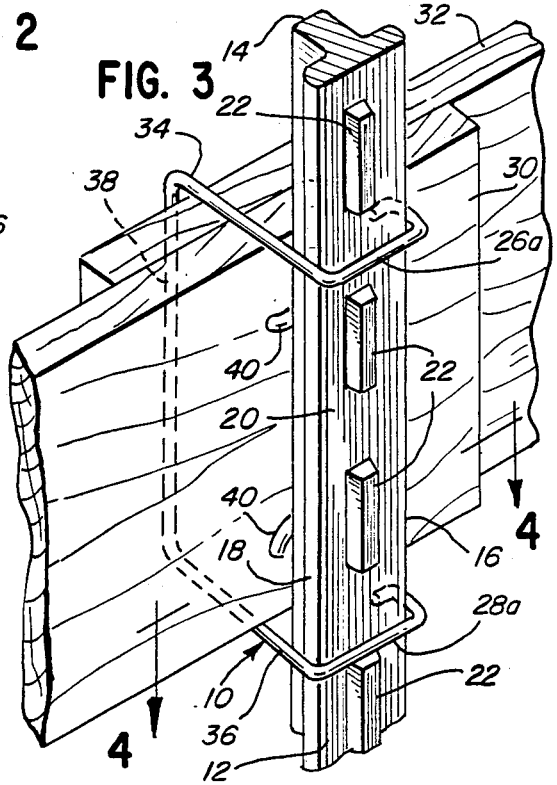
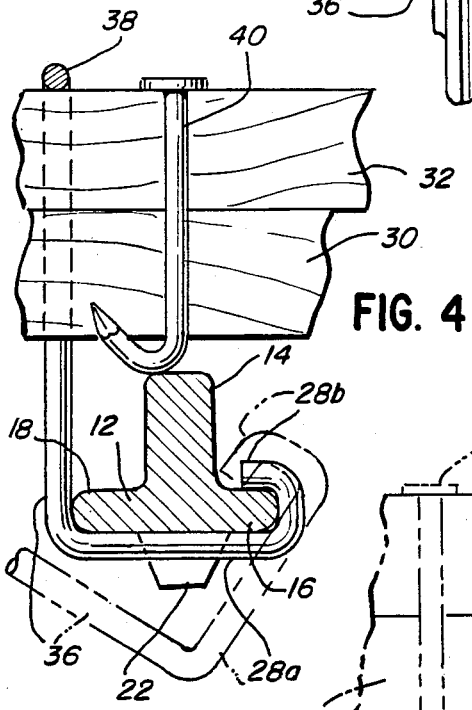
FIG. 4
FIG. 5
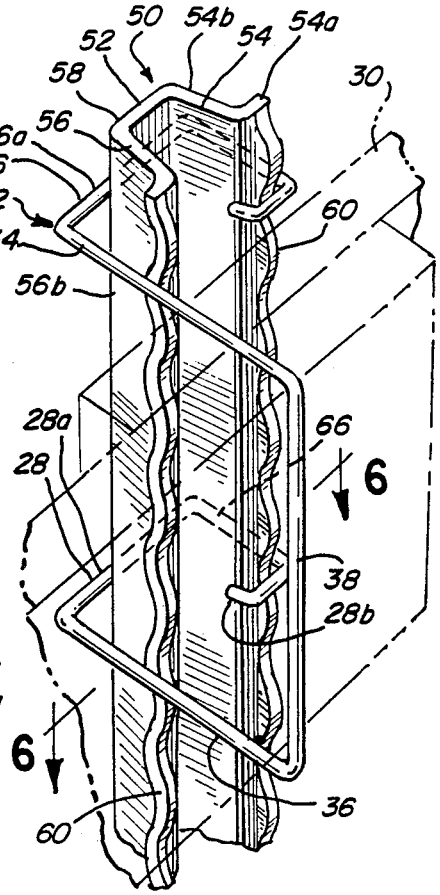
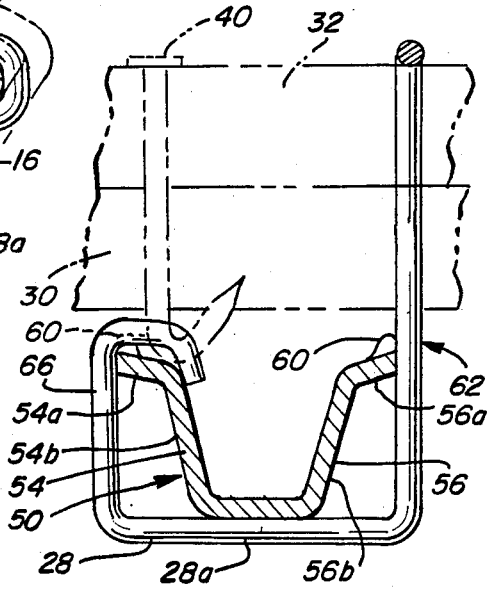
FIG. 6

FENCE BRACKET

DESCRIPTION

1. Technical Field

The present invention relates generally to fence construction and more particularly to a bracket for securing wooden or other rails on a metal fence post.

2. Background Art

Fences have been designed and constructed wherein horizontal rails are secured to vertical metal fence posts by means of hooks or clasps. For example, Bettis U.S. Pat. No. 57,073 discloses the use of iron hooks which surround a circular metal fence post and which are secured at a desired height on the post by a wedge or key. Overlapping horizontal boards extend through a front portion of the iron hook and are supported thereby.

Gleason U.S. Pat. No. 266,988 discloses a metallic clasp for securing overlapping rails on a fence post. The clasp includes a pair of hooked portions, one of which extends through an aperture in the middle of the post and is hooked around a rear edge of the side of the post, and the other of which is retained within a recess to maintain the bracket at the desired height on the post. The clasp is specifically adapted for use with fence posts having recesses in one face thereof.

Applicant has also designed a prior type of bracket for securing a wooden or other horizontal fence rail to a metal fence post. In applicant's copending patent application entitled "Fence Mounting Bracket", Ser. No. 715,493, filed Mar. 25, 1985, there is disclosed a bracket which includes a frame that is slidable on the post and means associated with and bendable relative thereto into interfering relationship with one or more protrusions on the fence post to maintain the bracket at a fixed height on the post. The bracket includes at least one, and preferably two arms each of which includes a bearing edge for supporting rails.

The first two devices described above suffer from various disadvantages. For example, the hooks disclosed in Bettis can only be installed on a fence post by sliding the hook over the top of the fence post and down the length of the fence post until the desired height is reached. Therefore, barbed wire or other fencing apparatus already on the post must be removed before the hook can be installed.

The metallic clasp of Gleason can be installed while wire is fixed on the post. However, the clasp is only capable of use with one type of fence post, i.e. those having a recess on one face thereof. This type of fence post is not in wide use today and hence the Gleason clasp currently has limited usefulness, at best.

While the fence mounting bracket disclosed in applicant's above-identified copending patent application is highly useful to secure horizontal rails on currently widely available fence posts, this bracket also suffers from the limitation in that it cannot be installed on the post when the post is already supporting fencing apparatus.

SUMMARY OF THE INVENTION

In accordance with the present invention, a fence bracket is provided for mounting horizontal rails on widely used metal fence posts and can be installed even while the post is supporting other fencing apparatus.

More particularly, a first embodiment of the fence bracket of the present invention is particularly adapted for use on T-shaped metal fence posts that include a rearward face having a series of protrusions longitudinally spaced along the face. The bracket includes first and second fingers extending around a portion of the fence post wherein each finger includes a hooked portion which is disposed over and engages a flange on the fence post. At least one of the fingers is engagable with one of the protrusions to limit movement of the bracket on the post. Also included is means connecting the first and second fingers for supporting overlapping ends of adjacent fence rails so that the rails may be mounted in fixed relation on the fence post. In the preferred embodiment, both of the fingers are disposed in substantially horizontal planes and the supporting means comprises first and second horizontally disposed support members joined to the first and second fingers, respectively, and a vertically disposed connecting member extending between the support members to define an opening forwardly of the fence post for accepting the overlapping ends of the adjacent rails.

In a further embodiment of the invention which is particularly suitable for use with fence posts of U-shape in cross-section having an outturned flange on the end of each leg of the U wherein a series of protrusions are spaced longitudinally along each flange, each finger of the bracket includes an elongate extension portion disposed between the hooked portion and the portion straddling a rear face of the post so that the fingers extend across the rearward face and one of the adjacent side faces of the post. In this case, the hooked portion engages the end of one of the flanges or legs of the U so that the bracket is held firmly on the post.

In either embodiment, one or more fasteners, such as a nail, may be driven through the overlapping ends of the rails so that the rails are securely fastened to the post.

Also, in either embodiment the bracket is easily assembled on the post from the side rather than from the top simply by engaging the hooked portion on the appropriate flange of the post and by rotating the entire bracket until the fingers rest squarely against the rear face of the post. In this fashion, there is no need to remove any existing fencing apparatus which is already supported by the post.

BRIEF DESCRIPTION OF THE DRAWINGS

FIG. 1 is a perspective view of a preferred embodiment of the bracket of the present invention for use with T-shaped metal fence posts;

FIG. 2 is a perspective view of the bracket of FIG. 1 partially assembled on a metal fence post taken from a different angle from that of FIG. 1;

FIG. 3 is a view similar to FIG. 2 showing the bracket as fully assembled on the post;

FIG. 4 is a sectional view taken along lines 4—4 of FIG. 2 with overlapping fence rails shown assembled within the bracket;

FIG. 5 is a perspective view of an alternative embodiment of the invention for use with U-shaped metal posts; and FIG. 6 is a sectional view taken along the lines 6—6 of FIG. 5 with overlapping fence rails shown assembled within the bracket.

DESCRIPTION OF THE PREFERRED EMBODIMENT

Referring now to FIGS. 1–4, there is illustrated in detail a preferred embodiment of a fence bracket 10 according to the present invention. As seen in FIGS. 3 and 4, the bracket 10 is particularly adapted for use with T-shaped fence posts 12 having a main body 14, first and second longitudinal flanges 16,18 and a rear face 20 having protrusions 22 spaced longitudinally along the face 20.

The bracket 10 includes first and second fingers 26,28 each having main portions **26*a*,28*a*, respectively. Each finger 26,28 also includes hooked portions 26*b*,28*b*, respectively. As seen in FIGS. 3 and 4, when the bracket 10 is in installed position on the post 12, the fingers extend around a portion of the fence post and more particularly straddle or extend across the rear face 20, and are disposed over and engage the flange 16 of the post. Further, one or both of the main portions 26*a*,28*a* is engagable with one of the protrusions 22 to limit longitudinal, i.e. upward and downward, movement of the bracket 10 on the post 12**.

As seen in the figures, the fingers 26,28 are disposed in substantially horizontal planes. Means are provided for supporting overlapping ends 30,32 of adjacent fence rails so that the rails are mounted in fixed relation on the fence post 12. In the preferred embodiment of the invention, the supporting means comprises first and second horizontally disposed support members 34,36 which are joined to and associated with the main portions **26*a*,26*b* of the fingers 26,28, respectively. Each support member 34,36 lies in the same plane as its associated main portion 26*a*,28*a* and is disposed transversely relative thereto. A vertically disposed connecting member 38 extends between and is joined to the support members 34,36. The support members 34,36 and the vertical connecting member 38 together define an opening through which the ends 30,32 may extend. It can be seen that this opening extends forwardly of the fence post 12** and slightly to one side thereof.

One or more fasteners, such as a nail 40, may be driven through the overlapping ends 30,32 of the rail to fasten same in fixed relation on the post 12. Depending upon the length of nail 40 used, it may occur that the nail strikes the main body 14 of the post 12 and is bent either to one side or the other of the main body or back into one or both of the ends 30,32 of the rails.

Referring now specifically to FIGS. 2 and 3, the bracket 10 is installed from the side of the post by first hooking the hooked portions **26*a*,26*b* of the fingers 26,28 over either of the flanges 16,18 of the post 12. The bracket 10 is then rotated so that the finger main portions 26*a*, 26*b* of the fingers 26,28 are substantially in contact with or abut the rear face 20 of the post 12. The length of the support members 34,36 is selected keeping in mind the thickness of the rails so that the rails prevent substantial rotational movement of the bracket 10** once assembled on the post.

In the preferred embodiment, the bracket 10 is formed of a single piece of 3/16 inch diameter stainless steel rod which is bent or otherwise formed to the desired shape.

In the preferred embodiment, each of the support member 34,36 is approximately 215/16 inches in length, each of the main portions **26*a*, 26*b* is approximately 111/32 inches in length, the vertical member is approximately 5⅝ inch in length and the portions disposed at 90° with respect to one another of the hooked portions 26*b*,28*b*** are each approximately ¼ inch in length.

As previously noted, the bracket shown in FIGS. 1–4 is particularly adapted for use with T-shaped fence posts. Referring now to FIGS. 5 and 6 there is illustrated a further embodiment of the invention which is adapted for use with U-shaped metal posts. It should be noted that structures or elements which are common to the figures are designated with like reference numerals.

A U-shaped post 50 includes a main portion 52 and first and second longitudinal legs 54,56 spaced on either side of the main portion 52. Disposed on the end of each leg 54,56 is an outturned flange **54*a*,56*a*, respectively. A series of protrusions 60 are longitudinally spaced along each flange 54*a*,56*a*. A bracket 62 includes the fingers 26, 28 having main portions 26*a*,28*a* as disclosed in FIGS. 1–4. The fingers 26,28 also include the hooked portions 26*b*,28*b*; however, the hooked portions 26*b*,28*b* are joined to the main portions 26*a*,28*a* by extensions 64,66, respectively, which, when the bracket 62 is installed on the post 50, are adjacent one of a pair of side faces 54*b*,56*b* of the legs 54,56**.

The bracket 62 includes the support members 34,36 and the vertically disposed connecting member 38 described in connection with FIGS. 1–4.

The bracket 62 is installed on the fence post 50 in a similar fashion as described in connection with the previous embodiment. That is, the bracket 62 is installed from the side of the post 50 by placing the hooked portions **26*a*,26*b* over one of the flanges 54*a*,56*a* and the end of one of the legs 54,56 (shown in the figures as being placed over the flange 54*a* and the end of the leg 54) and by rotating the bracket 62 relative to the post 50 until the main portions 26*a*,26*b* substantially abut the rear face 58. In this embodiment, substantial longitudinal movement of the brackets 62 relative to the post is prevented by the engagement of one or both of the hooked portions 26*b*,26*c* with one or more protrusions 60. The bracket 62, when installed, therefore includes fingers 26,28 which extend across the rear face 58 and at least one and preferably both side faces 54*b*, 56*b***.

Once the bracket is installed on the post, the ends 30,32 of the adjacent rails are passed through the opening defined by the support members 34,36 and the vertically disposed member 38, and one or more nails or fasteners is driven through the overlapping ends 30,32 to hold the rails in place relative to the post 50.

It should be noted that the placement of the fastener or nail 40 as shown in the figures is not critical, it being understood that the nail may pass through the ends 30,32 at another place, if desired.

It should also be noted that the bracket of the present invention may be adaptable to other types of metal fene posts having different cross-sectional shapes simply by varying the lengths of the main portions **26*a*,28*a*, the extensions 64,66, the support members 34,36 or the hooked portions 26*a*,28*a*. Further, different size rails can be easily accommodated simply by varying the length of the support members 34,36 and/or the vertically disposed member 38**.

The bracket of the present invention provides a simple and effective means of securing horizontal wooden or other rails to a widely used metal fence posts of various cross-sectional shapes without the need of first removing other fencing apparatus supported by the post.

I claim:

1. A fence bracket for mounting adjacent fence rails in fixed relation on a fence post of the type having protrusions longitudinally spaced along the post, comprising:

first and second fingers extending around a portion of the fence post and each having a hooked portion which is disposed over and engages a flange of the fence post wherein at least one of the fingers is engagable with one of the protrusions to limit movement of the bracket on the post; and means disposed between the first and second fingers for supporting overlapping ends of the adjacent fence rails.

2. The fence bracket of claim 1, wherein both of the fingers are disposed in substantially horizontal planes and wherein the supporting means includes first and second horizontally-disposed support members joined to the first and second fingers, respectively, and a vertically-disposed member extending between the support members whereby the fence bracket may be installed from the side of the post without requiring the prior removal of other fencing apparatus supported by the post.

3. The fence bracket of claim 1, wherein the fence post is U-shaped having a rear face and a pair of side faces disposed on either side of the rear face and wherein the fingers extend across the rear face and at least one of the side faces.

4. The fence bracket of claim 1, in combination with a fastener extending through the overlapping ends of the adjacent fence rails to maintain the rails in fixed relationship with respect to the fence post.

5. The fence bracket of claim 1, wherein the bracket is fabricated of metal rod.

6. A fence bracket for securing fence rails to a metal fence post wherein the post includes a main portion having a face, a series of protrusions spaced longitudinally along the post and at least one longitudinal flange, comprising:

first and second parallel fingers each having a main portion and a hooked portion;

first and second parallel support members coupled to and associated with the first and second fingers, respectively, each support member being in the same plane as its associated finger and being disposed transversely relative thereto; and a connecting member disposed between and secured to the first and second support members wherein the support and connecting members together define an opening, whereby the bracket is installed on the post by first placing the hooked portions of the fingers over the longitudinal flange and then rotating the bracket so that the main portions of the fingers substantially abut the face of the main portion of the post and at least one of the protrusions limit substantial longitudinal movement of the bracket on the post and the opening extends outwardly from the post so that overlapping ends of adjacent rails may be placed within the opening to thereby mount the rails on the post.

7. The fence bracket of claim 6, wherein the fence post is U-shaped in cross-section and wherein the hooked portion of each finger is connected by an elongate extension to the main portion thereof.

8. The fence bracket of claim 6, wherein the hooked portion of each finger is of a length sufficient to prevent inadvertent detachment of the bracket from the post even before the rails are assembled in the opening.

9. The fence bracket of claim 1, wherein the fence post includes a longitudinal axis and wherein the fingers of the fence bracket are disposed in planes transverse to the longitudinal axis and wherein the supporting means includes first and second support members extending transversely of the longitudinal axis and joined to the first and second fingers, respectively, and a connecting member extending between and joined to the support members.

10. The fence bracket of claim 9, wherein the connecting member is substantially parallel to the longitudinal axis of the post.

11. A fence bracket for securing fence rails to a metal fence post wherein the post is T-shaped in cross-section and includes a main portion having a face, a series or protrusions spaced longitudinally along the post and at least one longitudinal flange, comprising:

first and second parallel fingers each having a main portion and a hooked portion wherein the hooked portion of each finger is connected directly to the main portion of such finger;

first and second parallel support members coupled to and associated with the first and second fingers, respectively, each support member being in the same plane as its associated finger and being disposed transversely relative thereto; and a connecting member disposed between and secured to the first and second support members wherein the support and connecting members together define an opening, whereby the bracket is installed on the post from the side thereof by first placing each of the hooked portions of the fingers over a longitudinal flange and then rotating the bracket so that the main portions of the fingers substantially abut the face of the main portion of the post, at least one of the protrusions limit substantial longitudinal movement of the bracket on the post and the opening extends outwardly from the post so that overlapping ends of adjacent rails may be placed within the opening to thereby mount the rails on the post.

12. A fence bracket for mounting adjacent fence rails in fixed relation on a fence post of the type having a T-shape in cross-section and further having protrusions longitudinally spaced along the post and extending along a rear face thereof, comprising:

first and second fingers extending across the rear face of the fence post and each having a hooked portion which is disposed over and engages a flanged of the fence post wherein at least one of the fingers is engagable with one of the protrusions to limit movement of the bracket on the post; and means connecting the first and second fingers for supporting overlapping ends of the adjacent fence rails.

* * * * *